US005081939A

United States Patent [19]

Esser

[11] Patent Number: 5,081,939

[45] Date of Patent: Jan. 21, 1992

[54] ROLLER-TYPE GRATE AND BAR THEREFOR

[75] Inventor: Anton Esser, Kaarst, Fed. Rep. of Germany

[73] Assignee: Deutsche Babcock Anlagen Aktiengesellschaft, Krefeld, United Kingdom

[21] Appl. No.: 638,611

[22] Filed: Jan. 8, 1991

Related U.S. Application Data

[62] Division of Ser. No. 521,047, May 3, 1990.

[30] Foreign Application Priority Data

May 10, 1989 [DE] Fed. Rep. of Germany ..... 8905822
May 10, 1989 [DE] Fed. Rep. of Germany ..... 8905823

[51] Int. Cl.[5] ..... F23K 3/18

[52] U.S. Cl. ..... 110/276; 126/167; 110/246

[58] Field of Search ..... 110/276, 275, 268, 246; 126/181, 167

[56] References Cited

U.S. PATENT DOCUMENTS

| | | | |
|---|---|---|---|
| 2,257,295 | 9/1941 | Gaul . | |
| 2,372,260 | 3/1945 | Dilg . | |
| 3,078,839 | 2/1963 | Mitchell et al. | 126/167 |
| 3,469,544 | 9/1969 | Kremer | 110/246 |
| 4,240,402 | 12/1980 | Martin et al. | 126/167 |
| 4,368,723 | 1/1983 | Biro et al. | 110/276 |
| 4,537,139 | 8/1985 | Esser | 110/276 |
| 4,610,209 | 9/1986 | Temelli | 110/276 |

FOREIGN PATENT DOCUMENTS 656692 7/1986 Switzerland .

*Primary Examiner*—Henry C. Yuen
*Attorney, Agent, or Firm*—Herbert Dubno; Andrew M. Wilford

[57] ABSTRACT

A bar for a rotary grate is of T-section and has an enlarged head and a fin projecting inwardly therefrom. The head is formed with an end face directed outward from the fin and a pair of substantially parallel side faces extending inward obliquely from the end face. The side faces extend at an angle of between 40° and 75°, preferably about 60°, to the end face. Thus air exiting from inside the roller-grate drum flows obliquely to a radius from the drum-rotation axis. This ensures that even if the material being burned does not form a continuous layer on the surface of the roller, the air will be likely to impinge this material. The fin extends generally centrally from the head and has a centerline that generally bisects the head. The bar has ends formed with blocks projecting to opposite sides of the bar so that blocks of adjacent bars can interfit. Furthermore the bars are arranged in sets with the bars of each set aligned longitudinally with the bars of the same set and each bar is formed with at least one axially throughgoing hole. In this case the drum is provided with respective holding bars traversing the holes of each set of bars.

5 Claims, 4 Drawing Sheets

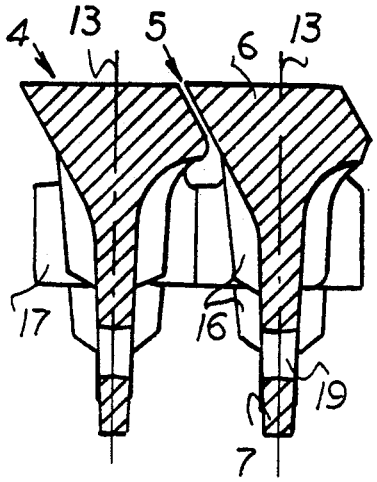
FIG.5
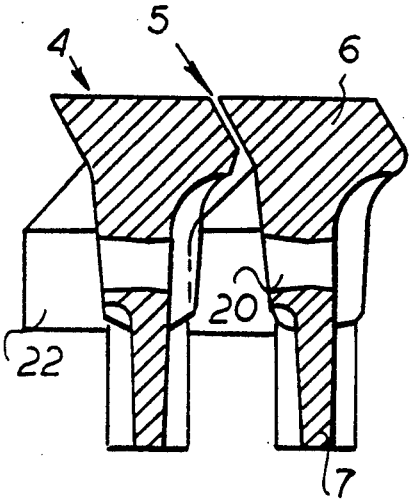
FIG.6
FIG.7
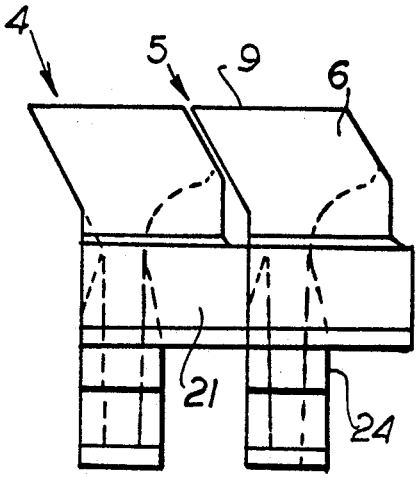
FIG.8
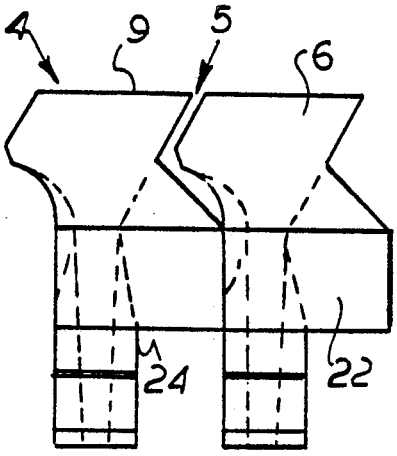

ROLLER-TYPE GRATE AND BAR THEREFOR

This is a division of co-pending application Ser. No. 521,047, filed on May 3, 1990.

FIELD OF THE INVENTION

The present invention relates to a roller-type grate of the type used to burn refuse. More particularly this invention concerns a bar for such a grate.

BACKGROUND OF THE INVENTION

It is known to burn refuse or the like on a grate made of a plurality of adjacent cylindrical rollers that are all rotated to mix and move the material being moved. Combustion air can pas through gaps in the rollers to gain access to the material being burned.

As described in U.S. Pat. No. 4,537,139 such a roller is comprised of a central shaft that is centered on and rotated about a longitudinal axis and that is provided externally with a plurality of normally T-section guides that in turn support an array of massive metallic grate bars. Each grate bars extends angularly over a small portion of the periphery of the roller and has ends fitted to the guides so that a plurality of bars together form a single ring and a stack of such rings form the roller.

The standard grate bar is, as mentioned, arcuate and of T-section, having relative to the roller axis a massive outer head forming the outer wear surface, and a radially inwardly projecting thin stiffening fin or leg. This is the basic grate-bar design used even in standard nonrolling grates as described in U.S. Pat. Nos. 2.372,260 and 2,257,295. The bars of the roller-type grate are mounted with some play so that they form the above-described air-flow gaps and so that they do not become wedged in place even when the entire grate is heated. This T-section configuration is even used in a step-type grate as described in Swiss patent 656,692 filed 14 January 1982 by B. Andreoli.

In German patent document 3,341,835 filed 19 November 1983 by E. Auchter asymmetrical bars are employed that can pivot considerably on the roller. The bars are basically of L-section with angled heads so that on the top of the roller the bars can lie at an angle with the outer surfaces of the heads laterally abutting and forming a cylinder while on the bottom of the roller they hang straight down with the heads separate and their outer surfaces extending at an angle to the roller axis. Such a system has the considerable advantage that the gaps formed by the heads at the top of the roll are open at a nonright angle to the outer roll surface so that the likelihood of the exiting gas impinging something on the roll surface are increased, but this arrangement has o the other hand been found likely to jamming in the perpendicular position assumed at the bottom of the roller.

OBJECTS OF THE INVENTION

It is therefore an object of the present invention to provide an improved roller grate and grate bar therefor.

Another object is the provision of such an improved roller grate and grate bar therefor which overcomes the above-given disadvantages, that is which is of simple and inexpensive construction yet which ensures nonperpendicular exit of the gases from the interbar gaps.

SUMMARY OF THE INVENTION

A bar for a rotary grate according to the invention is of T-section and has an enlarged head and a fin projecting inwardly therefrom. The head is formed with an end face directed outward from the fin and a pair of substantially parallel side faces extending inward obliquely from the end face. The side faces extend at an angle of between 45° and 75°, preferably about 60°, to the end face.

Thus with this arrangement the air exiting from inside the roller-grate drum flows obliquely to a radius from the drum-rotation axis. This ensures that even if the material being burned does not form a continuous layer on the surface of the roller, the air will be likely to impinge this material.

According to this invention the fin extends generally centrally from the head and has a centerline that generally bisects the head. The bar has ends formed with blocks projecting to opposite sides of the bar so that blocks of adjacent bars can interfit. Furthermore the bars are arranged in sets with the bars of each set aligned longitudinally with the bars of the same set and each bar is formed with at least one axially throughgoing hole. In this case the drum is provided with respective holding bars traversing the holes of each set of bars.

DESCRIPTION OF THE DRAWING

The above and other objects, features, and advantages will become more readily apparent from the following, reference being made to the accompanying drawing in which:

FIGS. 5 and 6 are cross sections taken respectively along lines 5V—5V and 6V—6V of FIG. 3; and FIGS. 7 and 8 are end views taken respectively in the direction of arrows 7V and 8V of FIG. 3.

DESCRIPTION

Figure 1:
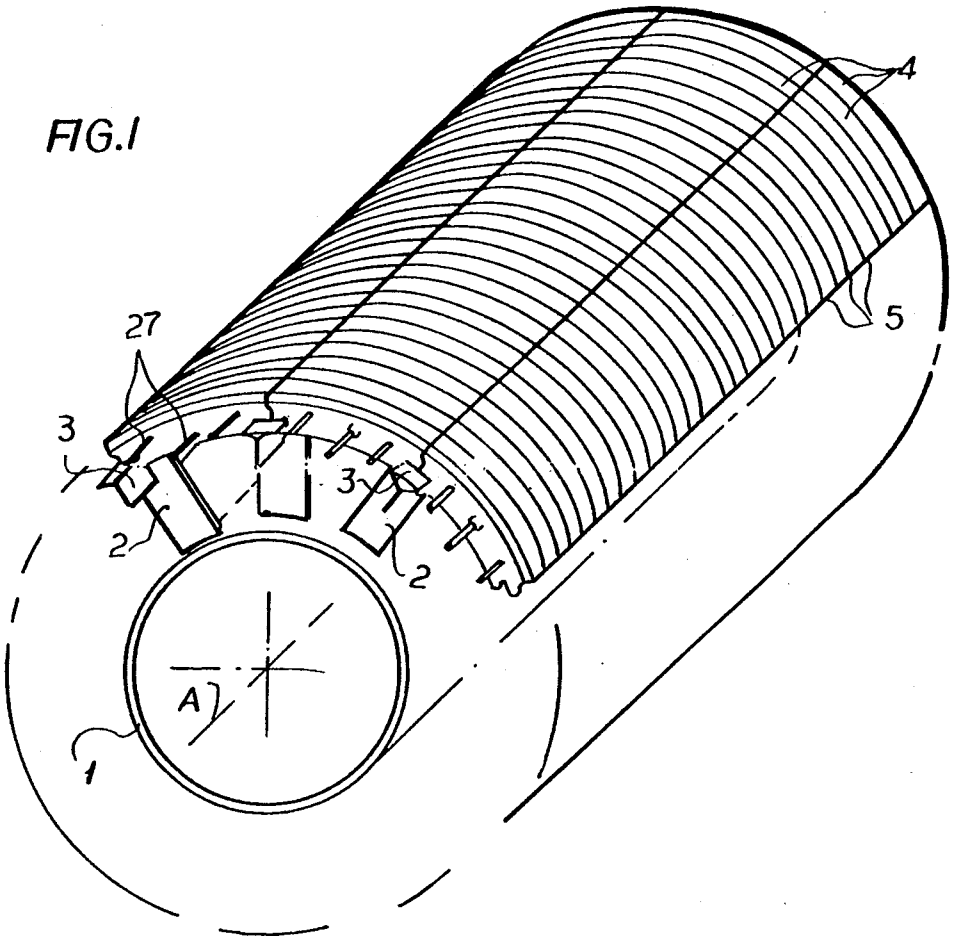
FIG. 1 is a small-scale perspective view of a rotary-grate drum according to this invention.

As seen in FIG. 1 a rotary-grate drum according to this invention, which typically is used with a plurality of other such drums, has a tubular core shaft 1 centered on a rotation axis A and provided with an array of radially outwardly projecting support struts 2 in turn carrying longitudinally extending T-section guide rails 3. The rails 3 extend parallel to the axis A, are angularly equispaced about this axis A to form a cage, and their flanges project oppositely tangentially. Fitted to these guide rails 3 are sets of identical grate bars 4 described in more detail below and defining outwardly open gaps or slots 5. The drum has ten of the rails 2 so that ten bars 4 together form a single angularly continuous ring, and a set of 100 such bars 4 is held between adjacent guide rails 3, for a total of 1000 bars 4 on the drum. Three stabilizer rods 27 project axially through each set of 100 bars 4.

Figure 2:
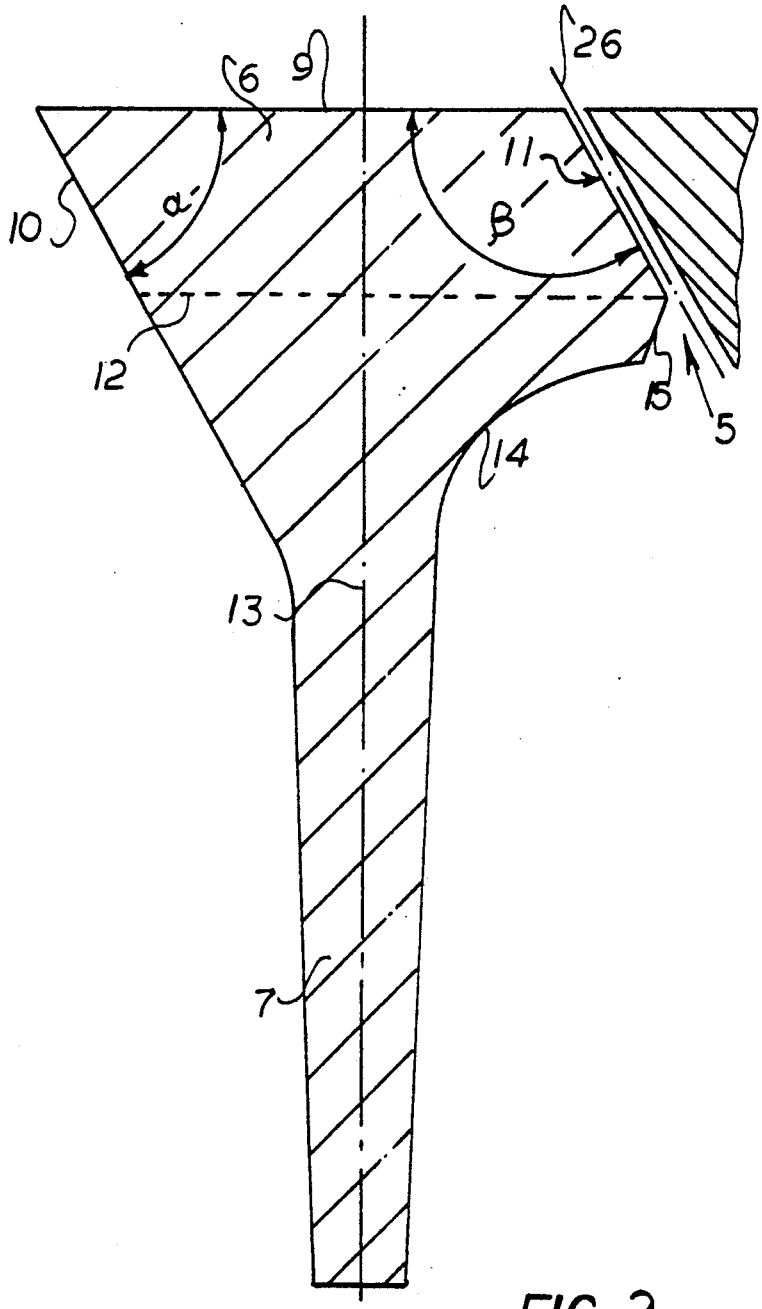
FIG. 2 is a cross-section through a grate bar according to the invention.

As seen in FIG. 2 each bar 4 has a massive head 6 and a relatively thin leg or fin 7. The head 6 has a part-cylindrical outer surface 9 formed of a family of parallel lines parallel to the axis A and a pair of flat side surfaces 10 and 11 each formed as a section of a surface of a cone. The surfaces 10 and 11 extend parallel to each other and obliquely to the surface 9 with each line of the surface 10 forming with the corresponding line of the surface 9 an angle $\alpha$ equal to 60° while each line of the family of lines making up the surface 11 forms with the corresponding line of the surface 9 an angle $\beta$ equal to 120°. Thus a line 12 extending parallel to the face 9 and joining the inner edge of the surface 11 to the surface !0 forms with the lines of the surfaces 9, 10, and 11 a rhomboid, that is a parallelogram having oblique-angle corners and adjacent sides of different lengths.

The side 10 extends inward to merge smoothly with the respective face of the fin 7. A short flat surface 15 extends at a large obtuse angle from the inner edge of the surface 11 and is joined by a smoothed curved surface 14 to the respective face of the fin 7. Thus each gap 5 is centered on a line 26 that opens obliquely at the outer surface of the drum. Furthermore a centerline or plane 13 through the fin 7 meets the surface 9 perpendicularly and generally divides the head 6 in half. This means that the line 13 divides the surface 9 proportionally to the angle $\alpha$, here in a ratio of 1:1.6 to 1:1.7, depending on the angle $\alpha$.

Figure 3:
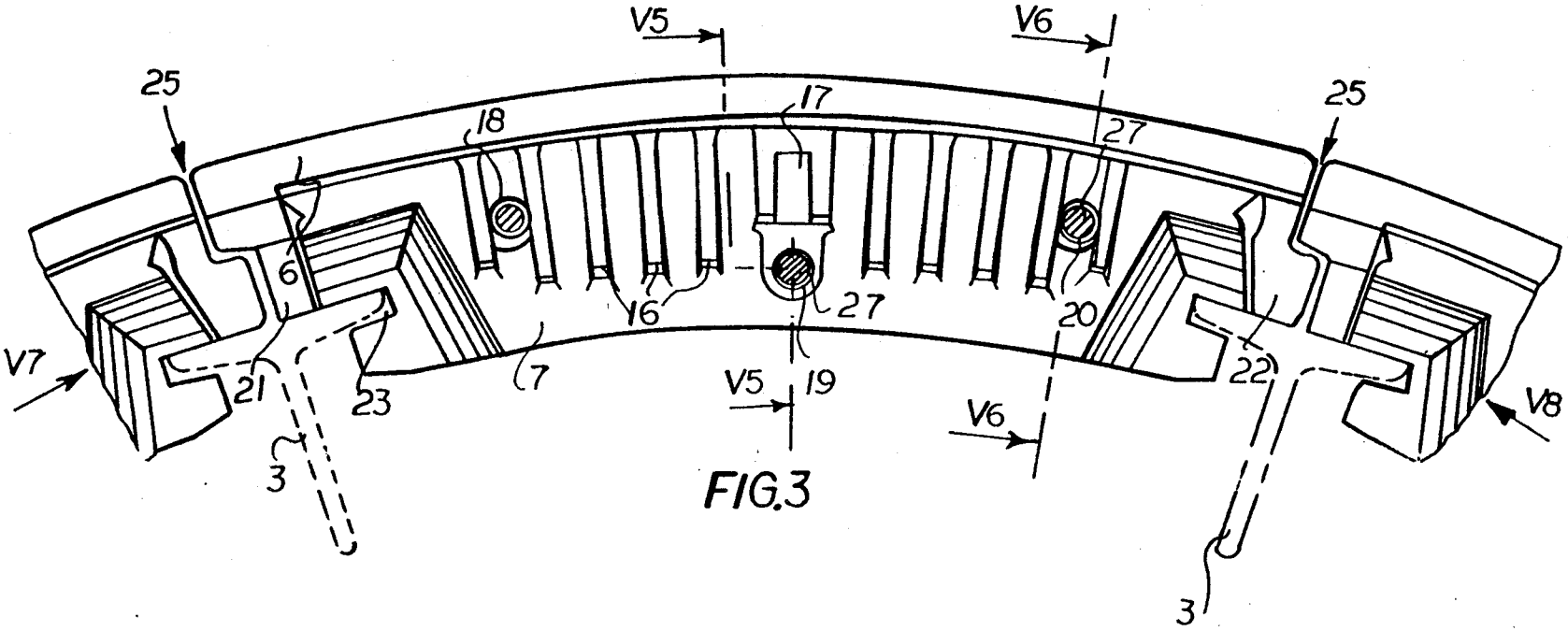
FIG. 3 is a side view of the grate bar.
Figure 4:
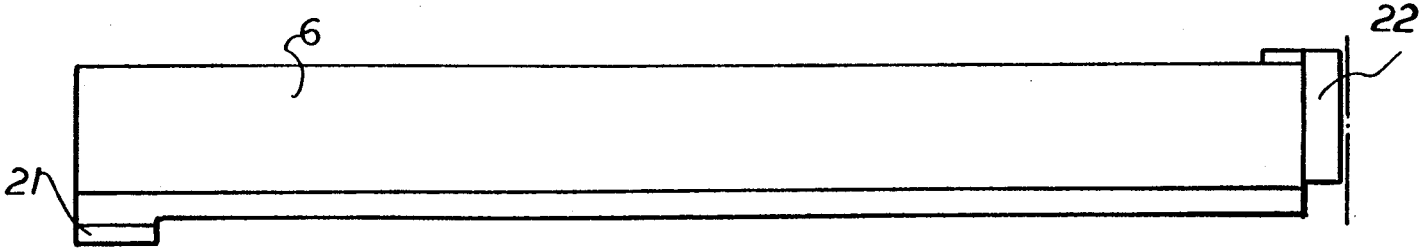
FIG. 4 is a top view of the bar shown straight for clarity of view.

FIGS. 3 and 5 show how each bar 4 is formed centrally in the corner between its head 6 and fin 7 with eight angularly spaced stiffening ribs 16 that project axially and serve both for reinforcement and heat dissipation. Furthermore at its center each bar 4 is formed on each longitudinal side with an axially projecting space bump 17 that axially engages the bump 17 of the adjacent bar 4 to keep the bars 4 longitudinally spaced and maintain the gaps 5 open. Each bar 4 is formed with three axially throughgoing holes 18, 19, and 20 through which the tabilizing rods 27 pass.

Each bar 4 is formed with a tangentially oppositely open end notches 23 and 24 that open longitudinally of the bar 4 and angularly of the drum and that are fitted over the flanges of the respective T-rails 3. In addition one end of each bar 4 is formed to one side of the leg 7 with a projecting spacer block 21 and the opposite end is formed on the opposite face of the leg 7 with a similar block 22. The blocks 21 and 22 lie radially of drum outward of the respective slots 23 and 24 and are dimensioned to axially engage the fin or leg 7 of the adjacent bar to form the desired spacing between bars. To this end each fin 7 has a crosswise thickness equal to about one-sixth of the center-to-center spacing parallel to the axis A between adjacent bars, with the axial dimension of the block 21 or 22 accounting for the rest of this dimension. The block 22 projects longitudinally from the respective end of the bar (it being understood that the longitudinal direction of the bar extends tangentially or angularly of the drum) while the block 21 is recessed complementarily in the opposite end so that the block 22 will fit under the end of the longitudinally adjacent bar. In this manner the bars 4 interfit with some overlap longituidnal so that the rails 3 are protected.

I claim:

1. A rotary-grate drum comprising:

a support centered on and rotatable about a longitudinal axis and having a plurality of angularly equispaced and longitudinally extending guides; and a plurality of arcuate grate bars having ends fitted to the guides with the bars extending angularly between the bars, each bar having an enlarged head and a fin projecting inwardly therefrom, the head being formed with an end face directed outward from the fin and a pair of substantially parallel side faces extending inward obliquely from the end face at an angle of between 45° and 75° to the end face, each bar forming with the adjacent bar an outwardly obliquely open gap.

2. The rotary-grate drum defined in claim 1 wherein the side faces extend at an angle of about 60° to the end face.

3. The rotary-grate drum defined in claim 1 wherein the fin extends generally centrally from the head and has a centerline that generally bisects the head.

4. The rotary-grate drum defined in claim 1 wherein the bar has ends formed with blocks projecting to opposite sides of the bar and fitted to the respective with the blocks of longitudinally adjacent bars interfitting complementarily.

5. The rotary-grate drum defined in claim 1 wherein the bars are arranged in sets with the bars of each set aligned longitudinally with the bars of the same set, each bar being formed with at least one axially throughgoing hole, the drum further comprising respective holding bars traversing the holes of each set of bars.

* * * * *